United States Patent [19]

Weimann

[11] Patent Number: 4,586,256

[45] Date of Patent: May 6, 1986

[54] KNIFE HANDLE

[75] Inventor: George F. Weimann, Avon, Conn.

[73] Assignee: The Stanley Works, New Britain, Conn.

[21] Appl. No.: 689,296

[22] Filed: Jan. 7, 1985

[51] Int. Cl.[4] ..... B26B 1/08

[52] U.S. Cl. ..... 30/162; 30/320; 30/335

[58] Field of Search ..... 30/162, 320, 335

[56] References Cited

U.S. PATENT DOCUMENTS

| | | | |
|---|---|---|---|
| 3,107,426 | 10/1963 | Robinson | 30/162 |
| 3,171,201 | 3/1965 | Carifi | 30/162 |
| 3,577,637 | 9/1968 | Braginetz | 30/162 |
| 3,708,881 | 1/1973 | Bennett | 30/320 |
| 3,872,591 | 3/1975 | Quenot | 30/162 |
| 4,170,062 | 10/1979 | Machida | 30/162 |
| 4,209,900 | 7/1980 | Gilbert | 30/162 |
| 4,242,795 | 1/1981 | Rollband | 30/162 |
| 4,509,260 | 4/1985 | Gringer | 30/320 |

FOREIGN PATENT DOCUMENTS

| | | | |
|---|---|---|---|
| 2704019 | 3/1978 | Fed. Rep. of Germany | 30/162 |

*Primary Examiner*—Jimmy C. Peters

*Attorney, Agent, or Firm*—Prutzman, Kalb, Chilton & Alix

[57] ABSTRACT

A knife handle employs a blade carrier having a planar blade support, a pair of parallel projecting flanges, and a laterally projecting lug for securing a blade in position to the carrier. A lateral retention tab extends from said carrier to capture an upper portion of a mounted blade for laterally securing said blade between said planar blade support and a bearing edge of the tab.

12 Claims, 6 Drawing Figures

KNIFE HANDLE

BACKGROUND OF THE INVENTION

This invention relates generally to knife handles adaptable for mounting a replaceable blade. More particularly, this invention relates to a knife handle for a utility knife employing a blade carrier for mounting a blade which carrier is either fixed within the handle or may be slidably moved from a sheathed position wherein a mounted blade is enclosed within the handle to an extended, unsheathed position wherein the knife blade projects through an opening in the handle to present a cutting edge.

Exemplary types of knife handles to which the present invention is particularly related are disclosed in U.S. Pat. No. 3,107,426, issued to W. H. Robinson, Jr., U.S. Pat. No. 3,872,591 issued to Michel Quenot, U.S. Pat. No. 3,577,637 issued to Paul A. Braginetz, U.S. Pat. No. 4,242,795 issued to Ernest J. Rollband and Robert F. West. Such utility knives incorporate a blade carrier which mounts and supports a blade at the interior of the handle for longitudinal movement therein. The blade carrier incorporates a thumb actuated button that can be depressed to unlatch the blade from one of several latch positions for shifting the blade via the carrier to another longitudinal position. The thumb actuated button may extend through a slot in the top of the knife handle and is secured to the blade carrier by means of a resilient finger. The knife handle is further adapted so that the blade may be relatively easily dismounted and replaced. The blades are replaced through the front opening of the knife handle or by gaining access through the side of the knife handle. Such knives have found great popularity and are of great utility in a wide variety of cutting operations.

While the foregoing utility knives are relatively inexpensive to manufacture and generally operate in an efficient and safe manner, a continuing concern with respect to either standard side-loading utility knives or front-loading utility knives is that during very heavy duty use the blade not disengage from the carrier and either jamb in the knife handle or entirely disengage from the knife handle. The present invention is directed to further insuring that the knife blade does not disengage from the carrier during heavy duty cutting operations.

BRIEF SUMMARY OF THE INVENTION

Briefly stated, the invention in a preferred form is a retractable blade handle comprising an elongated case which has a front blade opening and interiorly forms a pair of spaced guides. A blade carrier is slidably received in the guides for selective longitudinal movement along the guides between a retracted sheathed position and an extended unsheathed position so that in the unsheathed position, a blade mounted to the carrier extends through the blade opening to present a cutting edge. The blade carrier is adapted for mounting a blade and includes a planar blade support, a generally laterally projecting flange for retaining the blade in position and a tab adapted to capture a mounted blade for lateral retention of the blade in cooperation with the blade support.

The blade carrier preferably includes a lug which is adapted for engagement with a notch at the top of a mounted blade to secure the blade to the carrier. The tab includes a bearing edge which is laterally spaced from the planar blade support for capturing a mounted blade between the planar support and the bearing edge. The tab extends from an upper portion of the carrier generally rearwardly from the lug. In a preferred form, the tab extends generally forwardly and downwardly from the carrier adjacent a resilient finger which extends rearwardly from an upper portion of the blade carrier and is adapted for manual actuation to selectively secure and locate the carrier in a plurality of longitudinal positions within the case.

In an alternative embodiment of the invention, the knife blade is non-retractable and the carrier is mounted in a fixed position within the handle. A lateral retention tab extends from the fixed carrier to prevent disengagement of the blade from the carrier.

An object of the invention is to provide a new and improved knife handle adaptable for mounting a replaceable blade.

Another object of the invention is to provide a new and improved knife handle having improved means for laterally retaining the blade to the carrier.

A further object of the invention is to provide a new and improved knife handle having an improved blade retention means which is easily and efficiently integrated into the blade carrier to further insure that the blade does not disengage from the carrier during very heavy duty use of the knife handle.

Other objects and advantages of the invention will become apparent from the specification and the drawing.

DETAILED DESCRIPTION OF THE INVENTION

Figure 1:
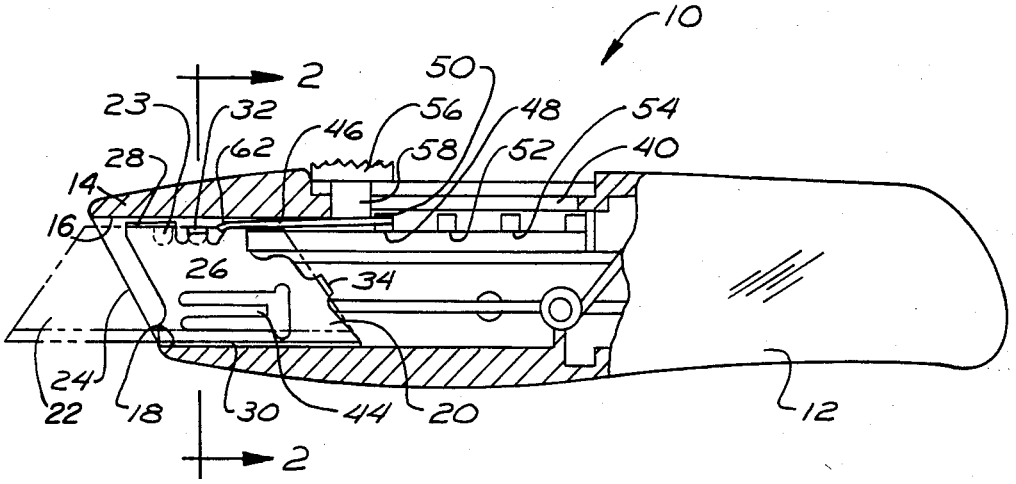
FIG. 1 is a side-elevational view of a retractable blade knife handle of the present invention, partly broken away and partly in section, a mounted blade being illustrated by broken lines.

With reference to the drawing wherein like numerals represent like parts throughout the several FIGURES, a retractable blade knife handle in accordance with the present invention is generally designated by the numeral 10. Knife handle 10 comprises a pair of mating case sections 12 and 14 which are assembled to form a hollow interior and an exterior which is contoured to facilitate grasping of the handle. Case section 14 interiorly forms equidistantly spaced guideways 16 and 18 for slidably mounting a generally planar blade carrier 20 for linear longitudinal movement interior of the case sections.

A removably replaceable blade 22 is mounted in fixed position to the blade carrier 20. The case sections cooperate to form a forward blade opening 24 so that the blade 22 may be longitudinally moved by the blade carrier to an extended unsheathed position wherein the cutting edge of the blade extends through the opening 24 to present a cutting edge as illustrated in FIG. 1. The blade carrier may be retracted to a sheathed position (not illustrated) by shifting the blade carrier (to the right of FIG. 1) so that the blade 22 is entirely enclosed by the case sections. The illustrated embodiment is a side-loading knife handle in that the mounted blade may be replaced by removing or pivotally opening the case sections to obtain access to the carrier. In this latter regard, knife handle 10 may be similar in form and function to that described in U.S. Pat. No. 3,107,426 or patent application Ser. No. 658,284 filed Oct. 5, 1984. The invention is equally applicable to a utility knife handle such as disclosed in U.S. Pat. No. 3,577,637 wherein the blade may be dismounted or mounted through the front opening of the case when the carrier is longitudinally moved to a forward longitudinal position and a retention lug is released. Excepting for the modifications described herein, the illustrated embodiment of knife handle 10 is similar in form and function to that described in U.S. application Ser. No. 658,284.

Blade carrier 20 includes a generally upright planar blade support 26. A flange 28 extends generally perpendicularly from the top of the blade support 26 toward the opposite case section 12. A second flange 30 parallel to flange 28 extends generally perpendicularly from the bottom of the blade support toward the opposite case section 12. Blade 22 engages against planar support 26 and is retained between flanges 28 and 30 of the blade carrier for generally upright vertical or transverse retention. Blade 22, which may be of a trapezoidal form having an upper locating notch 23 and a lower cutting edge, is retained in a fixed longitudinal position to the blade carrier by a lug 32. The blade may also be a hook blade such as blade 122 of FIG. 6, a scoring blade or other blade form suitably adapted for mounting to the blade carrier. Lug 32 generally laterally projects from the blade carrier at a position slightly below flange 28. Lug 32 engages the notch 23 at the top of the blade. The blade may also be retained in a fixed longitudinal position by a rearward retention tab 34 which extends obliquely relative to flanges 28 and 30 for engaging a rear non-cutting edge of the blade.

Figure 2:
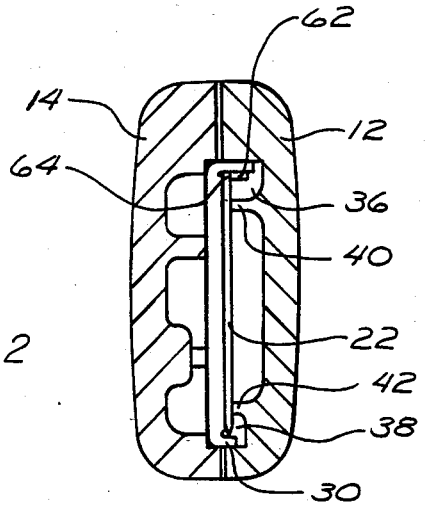
FIG. 2 is a sectional view of the retractable blade knife handle taken along the line 2—2 of FIG. 1.

Flanges 28 and 30 are additionally adapted for reception on guideways 16 and 18, respectively, for sliding movement therealong interiorly of the case sections. A pair of spaced longitudinally extending channels 36 and 38 are defined by a pair of spaced longitudinally extending retention ribs 40 and 42, respectively, which extend from the interior side of case section 12. The retention ribs 40 and 42 cooperate with the blade support to aid in the lateral retention of the intermediately positioned blade 22 as best illustrated in FIG. 2.

A longitudinally extending integral leaf spring 44 extends at an acute angle to the planar blade support 26 toward case section 14. Leaf spring 44 is located intermediate flanges 28 and 30. A projection (not illustrated) in the form of a ramp-like structure protrudes interiorly from an interior side of case section 14 at a forward portion thereof between guideways 16 and 18 and vertically aligns with leaf-spring 44. The projection forms a cam surface which is adapted for biasing engagement with the exterior surface of leaf-spring 44 so that when the carrier is longitudinally shifted to an extended cutting position, the cam surface of the projection engageably depresses the resilient leaf-spring toward the planar support 26. This latter engagement provides a forceful clamping engagement of the blade to limit the side or lateral movement of the blade at the extended position.

Figure 4:
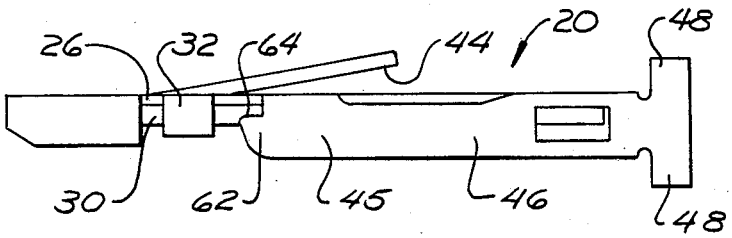
FIG. 4 is a top plan view of the blade carrier of FIG. 3.
Figure 3:
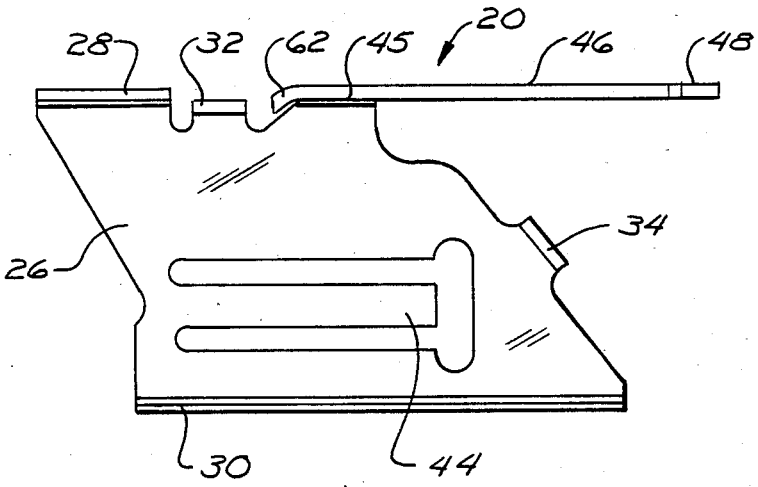
FIG. 3 is an enlarged side-elevational view of a blade carrier employed in the knife handle of FIG. 1.

A platform 45 generally aligns with flange 28 and extends generally perpendicularly toward case section 12 from an upper rear portion of planar blade support 26. An integral resilient finger 46 extends rearwardly from platform 45. A pair of oppositely projecting latching tabs 48 at the rear terminus of finger 46 are biased by the resilience of the finger 46 to be received in any one of notches 50, 52 and 54 to latch the blade carrier and hence to securely position a mounted blade in a selected sheathed or unsheathed longitudinal position. The foregoing notches are formed in the top interior of the case sections 12 and 14. In the knife handle illustrated in the drawing, reception of tabs 48 in notches 50, 52 and 54 define three unsheathed or cutting positions of blade 22. A thumb button 56 is connected to the resilient finger 46 by a neck 58 which extends upwardly through a longitudinal slot 40 formed in the top of the knife handle. The blade carrier 20 may be manually longitudinally shifted by pressing the thumb button 56 to unlatch the latching tab 48 and moving the blade carrier longitudinally with respect to the case sections An integral lateral retention tab 62 extends from a forward portion of the laterally projecting platform 45 which connects resilient finger 46 to the upper rear portion of carrier 20. The lateral retention tab 62 extends forwardly and downwardly at an acute angle to the platform. Lateral retention tab 62 forms a bearing edge 64 (illustrated in FIG. 4) which is generally parallel to the planar blade support 26 and equidistantly spaced therefrom. The distance between the bearing edge 64 and the planar blade support 26 is roughly commensurate with the thickness of a blade adapted for mounting to the carrier and is in preferred embodiments on the order of 0.015 inches, 0.025 inches, or 0.035 inches. Other blade thicknesses and corresponding distances may also be employed. Tab 62 is located rearwardly from lug 32. It will be appreciated that when the blade 22 is mounted or seated in the carrier, an extreme upper portion of the blade is captured between the bearing edge 64 of the lateral retention tab and the planar blade support. In this manner an additional efficient lateral retention structure is provided for laterally retaining the blade to the carrier. While the lateral retention tab 62 extends downwardly from the upper portion of the carrier to capture the blade, the downward extension of tab 62 is limited to allow the tab to be accommodated in the longitudinally extending channel 36 so that the tab does not impede the efficient longitudinal shifting of the carrier.

The lowermost portion of tab 62 is roughly level with lug 32. In addition, the retention tab does not detract from the efficient blade replacement characteristics of the knife handle. During heavy duty cutting operations when the blade is extended, the longitudinal push-pull cutting forces are partially distributed to the lug 32, and lug 32 becomes a focal point for forces exerted against the blade. By locating the lateral retention tab 62 in close proximity to lug 32, the magnitude of the heavy duty cutting forces exerted against the lug which would be sufficient to laterally disengage or dislodge the blade from the carrier seat is greatly increased, and hence the likelihood that the blade will disengage the carrier is substantially lessened.

In accordance with the invention, retention tab 62 may extend a greater length than that illustrated in the drawings. The retention tab may also extend forwardly and downwardly at various angles to the platform. It should be appreciated that the retention tab may also be located to depend from the forward portion of flange 28 or from rearward retention tab 34 rather than the foregoing described embodiment wherein the retention tab 62 depends from platform 45. The retention tab may thus be configured to extend generally rearwardly and downwardly from flange 28 and/or extend generally forwardly and/or generally downwardly from tab 34. Naturally, other directional orientations are also possible.

Figure 5:
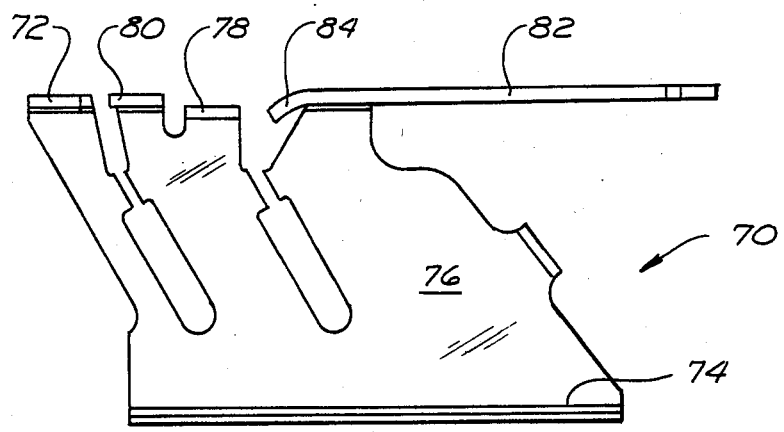
FIG. 5 is a side-elevational view of an alternate form of a blade carrier in accordance with the present invention.

The invention is equally applicable to a wide variety of non-retractable utility knives as well as retractable utility knives which employ a movable blade carrier to seat or mount the blade. With reference to FIG. 5, an alternate embodiment of a blade carrier 70 is illustrated. Blade carrier 70 is exemplary of a carrier employed in a utility knife wherein the blade may be dismounted and/or mounted by moving the carrier to an extended forward position and releasing a blade retention lug such as disclosed in U.S. Pat. No. 3,577,637. Blade carrier 70 includes a pair of parallel flanges 72 and 74 which are similar in function to that described with respect to flanges 28 and 30. Blade carrier 70 further includes a resilient intermediate separated planar section 76 which upwardly terminates in a latera11y extending lug 78 (which functions to engage a blade in a manner similar to lug 32) and an adjacent finger tab 80 adapted for mountinq a button. When the carrier 20 is moved to an extended position, manual lateral movement of the tab 80 forces the lug 78 to disengage from the notch of the blade to allow for replacement of the blade through the front opening of the knife handle. Blade carrier 70 includes a finger 82 and a lateral retention tab 84 which are structured and configured to function in substantially the same manner as previously described for finger 46 and tab 62 of carrier 20. Although the blade is replaced from a generally frontal orientation relative to carrier 70 as opposed to the generally side orientation for carrier 20, lateral retention tabs 62 and 84 do not materially interfere with the blade replacement process in either carrier embodiments. It should be appreciated that both blade carrier 20 and blade carrier 70 are integral members which may be formed from a sheet of metal such as steel by a process wherein the steel sheet is cut and then bent to form the foregoing described flanges, lugs, fingers, and lateral retention tabs. The carrier may also be die cast or formed from reinforced plastic.

Figure 6:
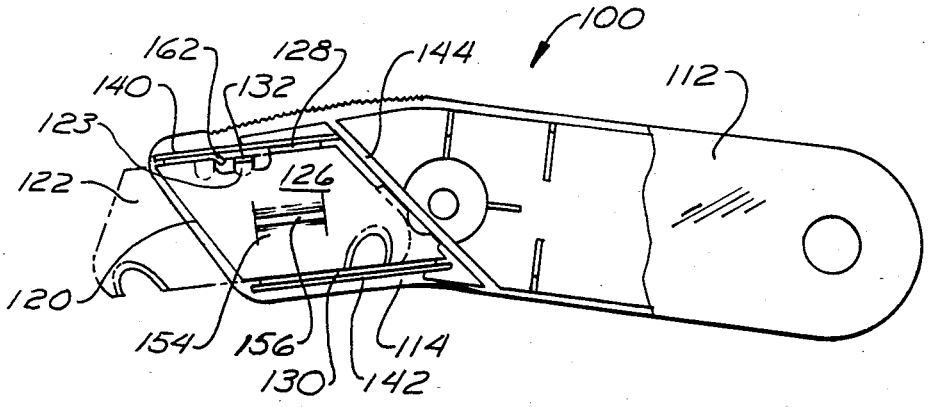
FIG. 6 is a side-elevational view of a non-retractable blade knife handle of the present invention partly broken away, a mounted blade being illustrated by broken lines.

With reference to FIG. 6, a non-retractable blade embodiment of a knife handle incorporating the present invention is generally designated by the numeral 100. Knife handle 100 includes a blade carrier 120 which is retained in fixed position to the knife handle within a forward retention cavity formed by parallel longitudinally extending ribs 140 and 142 and a cooperating obliquely extending rib 144. Blade carrier 120 includes a generally upright planar blade support 126 and a pair of parallel flanges 128 and 130 which extend generally perpendicularly for generally upright vertical or transverse retention of hook blade 122. A pair of engagement tabs 152 and 154 are punched from the central portion of support 126 and bent to engage a central longitudinally extending rib 156 to further maintain the fixed relationship between the carrier and the corresponding mating case sections 112 and 114.

The blade 122 is retained in a fixed longitudinal position to the blade carrier by a laterally projecting lug 132 which engages a notch 123 at the top of the blade. An integral lateral retention tab 162 extends from a forward portion of flange 128 to capture an upper portion of blade 122 for lateral retention thereof in a manner analogous to retention tab 162. Tab 162 extends generally downwardly and slightly rearwardly from flange 128 and includes a bearing edge (not illustrated) which is generally equidistantly spaced from planar support 126 a distance roughly commensurate with the thickness of blade 122. It will be appreciated that alternatively tab 162 may be configured to integrally depend from carrier 120 at a wide variety of locations and angular orientations (not illustrated) to provide a means for laterally capturing a mounted blade. The retention tab 162 essentially cooperates with support 126 to provide a blade trap which prevents disengagement of the blade from the carrier in the event that forces exerted at the forward portion of the knife handle force the case sections apart.

While a preferred embodiment of the invention has been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. A knife handle comprising:

an elongated case having a forward blade opening and interiorly forming a pair of spaced guide means, and a blade carrier adapted for mounting a blade and slidably received in said guide means for selective longitudinal movement therealong between a retracted sheathed position and an extended unsheathed position wherein a blade mounted to said carrier extends through said blade opening to present a cutting edge, said blade carrier including a planar blade supporting portion, retainer means projecting laterally away from said blade supporting portion to removably transversely retain a mounted blade by engaging opposing peripheral edges of said blade and tab means to capture a mounted blade for lateral retention thereof in cooperation with said blade supporting portion by engagement of a portion of said blade adjacent one said opposing blade edge.

2. The knife handle of claim 1 wherein said blade carrier further includes a lug means adapted for engagement with a notch at the top of a mounted blade for restraining the blade longitudinally relative to the carrier.

3. The knife handle of claim 1 wherein said tab means comprises a tab having a bearing edge which is laterally generally equidistantly spaced from said planar blade supporting portion for capturing a mounted blade therebetween.

4. The knife handle of claim 2 wherein said tab means extends generally forwardly and downwardly from an upper portion of said carrier and is disposed adjacent said lug means.

5. The knife handle of claim 1 further comprising a platform laterally projecting from said blade carrier at an upper portion thereof and a resilient finger extending rearwardly from said platform, said finger being adapted for manual actuation to selectively secure said carrier in a plurality of longitudinal positions within said case, said tab means integrally extending from said platform.

6. The knife handle of claim 3 wherein said bearing edge is spaced from said planar blade supporting portion a distance approximately commensurate with the thickness of a mounted blade.

7. A knife handle comprising:

an elongated case having a forward blade opening and interiorly forming a pair of spaced guide means and a blade carrier adapted for mounting a blade and slidably received in said guide means for selective longitudinal movement therealong between a retracted sheathed position and an extended unsheathed position wherein a blade mounted to said carrier extends through said blade opening to present a cutting edge, said blade carrier being an integral structure comprising a planar blade support, a pair of generally laterally projecting parallel flanges for transversely retaining said blade, a generally laterally projecting lug for engagement with a notch at the top of a mounted blade to restrain the blade longitudinally relative to the carrier, a platform laterally projecting from an upper rear portion of said blade support, a resilient finger extending rearwardly from said platform and adapted for latching said carrier at a plurality of longitudinal positions within said case, and a tab extending at an acute angle from a forward portion of said platform, said tab being disposed rearwardly from said lug and having a bearing edge which is generally parallel to said planar support and spaced therefrom.

8. The retractable knife handle of claim 7 wherein said blade carrier is adapted for seating a blade so that an upper portion of the blade is laterally captured between said tab and said planar support.

9. A knife handle comprising:

an elongated case having a forward blade opening and a blade carrier adjacent said opening and adapted for mounting a blade so that said mounted blade extends through said blade opening to present a cutting edge, said blade carrier including a planar blade supporting portion, retainer means projecting laterally away from said blade supporting portion to removably transversely retain a mounted blade by engaging opposing peripheral edges of said blade, lug means to restrain a mounted blade longitudinally relative to the carrier and tab means adapted to capture a mounted blade for lateral retention thereof in cooperation with said blade supporting portion by engagement of a portion of said blade adjacent one said opposing blade edge.

10. The knife handle of claim 9 wherein said tab means comprises a tab having a bearing edge which is laterally generally equidistantly spaced from said planar blade supporting portion for capturing a mounted blade therebetween.

11. The knife handle of claim 10 wherein said retainer means comprises a pair of parallel upper and lower flanges and said tab means extends generally forwardly and downwardly toward a lower flange.

12. The knife handle of claim 10 wherein said retainer means comprises a pair of parallel upper and lower flanges and said tab means extends generally rearwardly and downwardly toward a lower flange.

* * * * *